US009464406B2

(12) United States Patent
Matsuyama et al.

(10) Patent No.: US 9,464,406 B2
(45) Date of Patent: Oct. 11, 2016

(54) CONTROL SYSTEM FOR CONSTRUCTION MACHINE AND CONTROL METHOD

(71) Applicant: KOMATSU LTD., Tokyo (JP)

(72) Inventors: Toru Matsuyama, Kanagawa (JP); Yoshiki Kami, Hadano (JP); Masashi Ichihara, Hiratsuka (JP)

(73) Assignee: KOMATSU LTD., Tokyo (JP)

( * ) Notice: Subject to any disclaimer, the term of this patent is extended or adjusted under 35 U.S.C. 154(b) by 296 days.

(21) Appl. No.: 14/238,885

(22) PCT Filed: Apr. 12, 2013

(86) PCT No.: PCT/JP2013/061094

§ 371 (c)(1),
(2) Date: Feb. 14, 2014

(87) PCT Pub. No.: WO2014/167718

PCT Pub. Date: Oct. 16, 2014

(65) Prior Publication Data

US 2016/0097184 A1 Apr. 7, 2016

(51) Int. Cl.
*E02F 9/20* (2006.01)
*E02F 3/43* (2006.01)
(Continued)

(52) U.S. Cl.
CPC ..... *E02F 9/2033* (2013.01); *E02F 3/28* (2013.01); *E02F 3/435* (2013.01); *E02F 9/2029* (2013.01);
(Continued)

(58) Field of Classification Search
CPC ..... E02F 9/2033; E02F 9/2203
USPC ..... 701/50
See application file for complete search history.

(56) References Cited

U.S. PATENT DOCUMENTS 5,735,065 A 4/1998 Yamagata et al.
5,835,874 A 11/1998 Hirata et al.
(Continued)

FOREIGN PATENT DOCUMENTS

DE 69511033 T2 2/2000
JP 4-136324 A 5/1992
(Continued)

OTHER PUBLICATIONS

The International Search Report for the corresponding international application No. PCT/JP2013/061094, issued on Jul. 16, 2013.
(Continued)

*Primary Examiner* — John Q Nguyen
*Assistant Examiner* — Anshul Sood
(74) *Attorney, Agent, or Firm* — Global IP Counselors, LLP

(57) ABSTRACT

A construction machine has a work implement and a work implement operating device. The work implement has a boom, arm, and bucket. A limit velocity determining unit determines a limit velocity of the boom from the limit velocity of the entire work implement, the arm target velocity, and the bucket target velocity. The distance when the blade tip of the bucket is positioned outside of the design plane is a positive value and the velocity in a direction from inside of the design plane toward outside of the design plane is a positive value. The first limit condition includes a condition that the limit velocity of the boom is greater than the boom target velocity. When the first limit condition is satisfied, a work implement control unit controls the boom to match the limit velocity of the boom and controls the arm to match the arm target velocity.

11 Claims, 17 Drawing Sheets

(51) Int. Cl.
*E02F 9/22* (2006.01)
*E02F 9/26* (2006.01)
*E02F 3/28* (2006.01)

(52) U.S. Cl.
CPC ..... *E02F 9/2221* (2013.01); *E02F 9/2292* (2013.01); *E02F 9/2296* (2013.01); *E02F 9/262* (2013.01); *E02F 9/265* (2013.01)

(56) References Cited

U.S. PATENT DOCUMENTS 5,968,104 A * 10/1999 Egawa ..... E02F 3/435 37/414
6,169,948 B1 * 1/2001 Fujishima ..... E02F 3/435 172/4.5
6,275,757 B1 * 8/2001 Watanabe ..... E02F 3/437 172/6
2013/0315699 A1 11/2013 Matsuyama

FOREIGN PATENT DOCUMENTS

JP 8-333768 A 12/1996
JP 10-1968 A 1/1998
JP 2009-179968 A 8/2009
WO 2012/127912 A1 9/2012
WO 2012127914 A1 9/2012

OTHER PUBLICATIONS

The Office Action for the corresponding German application No. 11 2013 000 165.9, issued on May 12, 2016.

* cited by examiner

CONTROL SYSTEM FOR CONSTRUCTION MACHINE AND CONTROL METHOD

CROSS-REFERENCE TO RELATED APPLICATIONS

This application is a U.S. National stage application of International Application No. PCT/JP2013/061094, filed on Apr. 12, 2013.

BACKGROUND

1. Field of the Invention

The present invention relates to a control system for a construction machine and a control method.

2. Background Information

Conventionally, a method is known for excavating in a region by moving a bucket along a design plane in a construction machine that is equipped with a work implement. A design plane is a plane that indicates a target shape to be excavated, and a position on the design plane and a position of the bucket are recognized by a controller provided in the construction machine.

For example, an operator sets an entry prohibition zone for the work implement in a control system described in Japanese Laid-open Patent Publication No. H4-136324. The control system reduces command values of lever signals on the work implement in response to the distance from the bucket to a boundary line of an entry prohibition zone. As a result, the bucket is automatically stopped at the boundary line even if the operator mistakenly moves the blade tip into the entry prohibition zone. Further, the operator is able to determine if the blade tip is approaching the entry prohibition zone due to a reduction in the velocity of the work implement.

SUMMARY

However, the control system in Japanese Laid-open Patent Publication No. H4-136324 applies a limit to all the shafts of the work implement or to the shaft being manipulated in the direction approaching the boundary. Further, the work implement stops when the bucket reaches the boundary line. As a result, the operator may feel great discomfort in the operation.

Conversely, in order to reduce the sense of discomfort by the operator, a limit applied to the work implement in response to the operation by the operator is preferably reduced. During excavation, intended operations by the operator are strongly felt when operating the arm. Thus, when the control system applies a limit to the arm as described in Japanese Laid-open Patent Publication No. H4-136324, the operator easily feels a sense of discomfort.

An object of the present invention is to prevent the bucket from entering the design plane while reducing the discomfort felt by the operator in a construction machine.

A control system according to a first aspect of the present invention is a device for controlling a construction machine. The construction machine is equipped with a work implement and an operating device. The work implement has a boom, an arm, and a bucket. The operating device is a device for operating the work implement.

The control system is provided with a design plane setting unit, a target velocity determining unit, a distance obtaining unit, a limit velocity determining unit, a first limit determining unit, and a work implement control unit. The design plane setting unit sets a design plane for indicating a target shape to be excavated. The target velocity determining unit determines a boom target velocity in accordance with an operation amount of the operating device for operating the boom, an arm target velocity in accordance with an operation amount of the operating device for operating the arm, and a bucket target velocity in accordance with an operation amount of the operating device for operating the bucket. The distance obtaining unit obtains a distance between a blade tip of the bucket and the design plane. The limit velocity determining unit determines a limit velocity of the entire work implement on the basis of the distance. The first limit determining unit determines whether a first limit condition is satisfied. The work implement control unit controls the work implement.

The limit velocity determining unit determines a limit velocity of the boom from the limit velocity of the entire work implement, the arm target velocity, and the bucket target velocity. When the distance when the blade tip of the bucket is positioned outside of the design plane is a positive value and a velocity in a direction from the inside of the design plane toward the outside thereof is a positive value, the first limit condition includes a condition that the limit velocity of the boom is greater than the boom target velocity. When the first limit condition is satisfied, the work implement control unit controls the boom to match the limit velocity of the boom and controls the arm to match the arm target velocity.

When the first limit condition is satisfied in the control system of the construction machine according to the present aspect, the boom is controlled to match the limit velocity and the arm is controlled to match the arm target velocity. That is, only boom limitation is performed and arm limitation is not performed. Therefore, the arm target velocity changes directly in response to an operation by the operator. As a result, the bucket is prevented from entering the design plane while reducing the discomfort felt by the operator.

The first limit condition preferably further includes a condition that the distance is less than a first predetermined value. In this case, the boom limitation is performed when the blade tip of the bucket is moved to a position closer to the design plane than a position that is a distance equal to the first predetermined value away from the design plane.

The control system preferably is further provided with a second limit determining unit. The second limit determining unit determines whether a second limit condition is satisfied. The second limit condition includes a condition that the distance is smaller than a second predetermined value. The second predetermined value is smaller than the first predetermined value. When the second limit condition is satisfied, the work implement control unit controls the boom to match the limit velocity of the boom and controls the arm to match an arm limit velocity. An absolute value of the arm limit velocity is smaller than an absolute value of the arm target velocity.

In this case, when the second limit condition is satisfied, the boom is controlled to match the limit velocity of the boom, and the arm is controlled to match the arm limit velocity. Therefore, limitation of both the boom and the arm is performed when the distance between the blade tip of the bucket and the design plane is less than the second predetermined value. As a result, even if the bucket enters the design plane, an increase of the entry can be quickly suppressed.

The second predetermined value is preferably 0. In this case, only the boom limitation is performed and the arm limitation is not performed until the blade tip of the boom reaches the design plane. Then, when the blade tip of the boom crosses the design plane, both the boom limitation and the arm limitation are performed.

The second predetermined value is preferably larger than 0. In this case, both the boom limitation and the arm limitation are performed before the blade tip of the boom reaches the design plane. As a result, both the boom limitation and the arm limitation can be performed when the blade tip of the bucket is about to cross the design plane even before the blade tip of the bucket reaches the design plane.

The distance obtaining unit preferably obtains a deviation amount of the blade tip of the bucket at predetermined time periods. The deviation amount is an absolute value of a distance between the blade tip of the bucket and the design plane inside the design plane. The second limit condition further includes a condition that a current deviation amount is larger than a previous deviation amount. In this case, both the limitation of the boom and the limitation of the arm can be performed when the entry into the design plane by the bucket is about to increase.

The limit velocity determining unit preferably determines an arm deceleration coefficient on the basis of the current deviation amount and a displacement amount between a previous position and a current position of the blade tip of the bucket. The arm deceleration coefficient is a value greater than 0 and smaller than 1. The limit velocity determining unit determines the arm limit velocity by multiplying the arm target velocity by the arm deceleration coefficient. In this case, the velocity of the arm can be greatly reduced when the entry into the design plane by the bucket is about to increase.

When the first limit condition or the second limit condition is satisfied and the limit velocity of the entire work implement is smaller than a sum of the arm target velocity and the bucket target velocity, the work implement control unit preferably reduces the velocity of the boom to a velocity lower than the boom target velocity. In this case, the velocity of the entire work implement can be reduced to the limit velocity by reducing the velocity of the boom. As a result, the bucket is prevented from entering the design plane while reducing the discomfort felt by the operator.

When the first limit condition or the second limit condition is satisfied and the limit velocity of the entire work implement is greater than a sum of the arm target velocity and the bucket target velocity, the work implement control unit preferably moves the boom in the direction from the inside of the design plane toward the outside thereof. In this case, the velocity of the entire work implement can be reduced to the limit velocity by moving the boom in the direction from the inside of the design plane toward the outside thereof. As a result, the bucket can be prevented from entering the design plane.

The control system preferably is further provided with a third limit determining unit. The third limit determining unit determines whether a third limit condition is satisfied. The third limit condition includes a condition that the distance is smaller than the second predetermined value. When the third limit condition is satisfied, the work implement control unit controls the boom to match the limit velocity of the boom and controls the bucket to match the limit velocity of the bucket. An absolute value of the bucket limit velocity is smaller than an absolute value of the bucket target velocity.

A construction machine according to a second aspect of the present invention is provided with the abovementioned control system.

A control method according to a third aspect of the present invention is a method for controlling a construction machine. The construction machine is equipped with a work implement and an operating device. The work implement has a boom, an arm, and a bucket. The operating device is a device for operating the work implement. The method includes the following steps.

In a first step, a design plane is set for indicating a target shape to be excavated. In a second step, a boom target velocity is determined in accordance with an operation amount of the operating device for operating the boom, an arm target velocity is determined in accordance with an operation amount of the operating device for operating the arm, and a bucket target velocity is determined in accordance with an operation amount of the operating device for operating the bucket. In a third step, a distance between a blade tip of the bucket and the design plane is obtained. In a fourth step, a limit velocity of the entire work implement is determined on the basis of the distance. In a fifth step, whether a first limit condition is satisfied is determined. In a sixth step, the work implement is controlled. In the step for determining the limit velocity of the boom, the limit velocity of the boom is determined from the limit velocity of the entire work implement, the arm target velocity, and the bucket target velocity. When the distance when the blade tip of the bucket is positioned outside of the design plane is a positive value and the velocity in a direction from the inside of the design plane toward the outside thereof is a positive value, the first limit condition includes a condition that the limit velocity of the boom is greater than the boom target velocity. When the first limit condition is satisfied, the boom is controlled to match the limit velocity of the boom and the arm is controlled to match the arm target velocity in the step to control the work implement.

When the first limit condition is satisfied in the control method of the construction machine according to the present aspect, the boom is controlled to match the limit velocity and the arm is controlled to match the arm target velocity. That is, only boom limitation is performed and arm limitation is not performed. As a result, the bucket is prevented from entering the design plane while reducing the discomfort felt by the operator.

According to the present invention, the bucket is prevented from entering the design plane while reducing the discomfort felt by the operator in the construction machine.

DETAILED DESCRIPTION OF EMBODIMENT(S)

Figure 1:
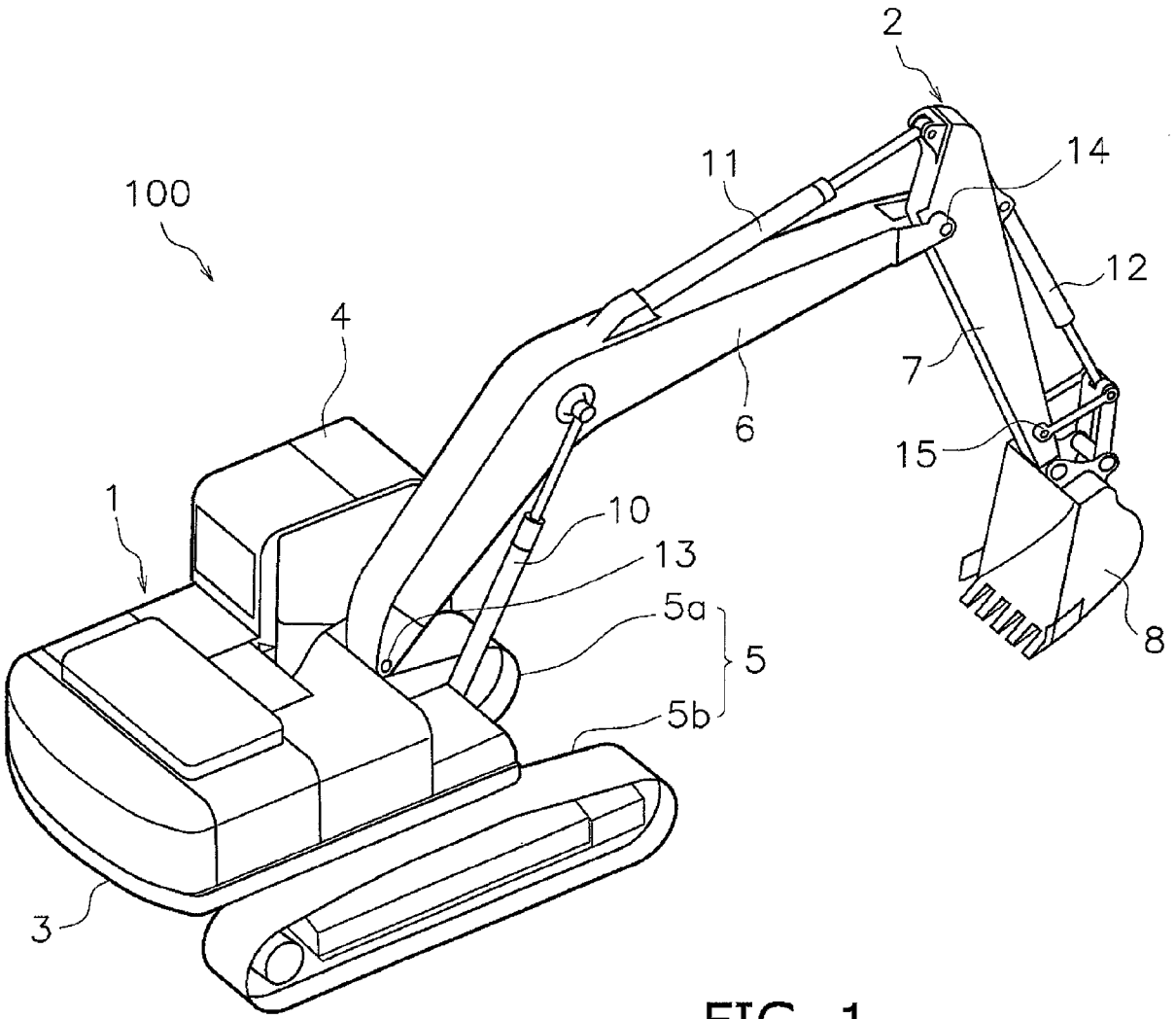
FIG. 1 is a perspective view of a hydraulic excavator.

Herein below, embodiments of the present invention will be described with reference to the accompanying drawings. FIG. 1 is a perspective view of a hydraulic excavator 100 according to an embodiment. The hydraulic excavator 100 has a vehicle body 1 and a work implement 2.

The vehicle body 1 has a revolving body 3, an operating cabin 4, and a travel device 5. The revolving body 3 contains devices such as an engine and a hydraulic pump described below. The operating cabin 4 is provided in the front section of the revolving body 3. An operating device described below is provided inside the operating cabin 4. The travel device 5 has crawler belts 5*a* and 5*b*, and the hydraulic excavator 100 travels due to the rotation of the crawler belts 5*a* and 5*b*.

The work implement 2 is attached to the front section of the vehicle body 1 and includes a boom 6, an arm 7, a bucket 8, a boom cylinder 10, and arm cylinder 11, and a bucket cylinder 12. The proximal end part of the boom 6 is attached in a swingable manner to the revolving body 3 via a boom pin 13. The proximal end part of the arm 7 is attached in a swingable manner to the distal end part of the boom 6 via an arm pin 14. The bucket 8 is attached in a swingable manner to the distal end part of the arm 7 via a bucket pin 15.

The boom cylinder 10, the arm cylinder 11, and the bucket cylinder 12 are all hydraulic cylinders that are driven by hydraulic fluid. The boom cylinder 10 drives the boom 6. The arm cylinder 11 drives the arm 7. The bucket cylinder 12 drives the bucket 8.

Figure 2:
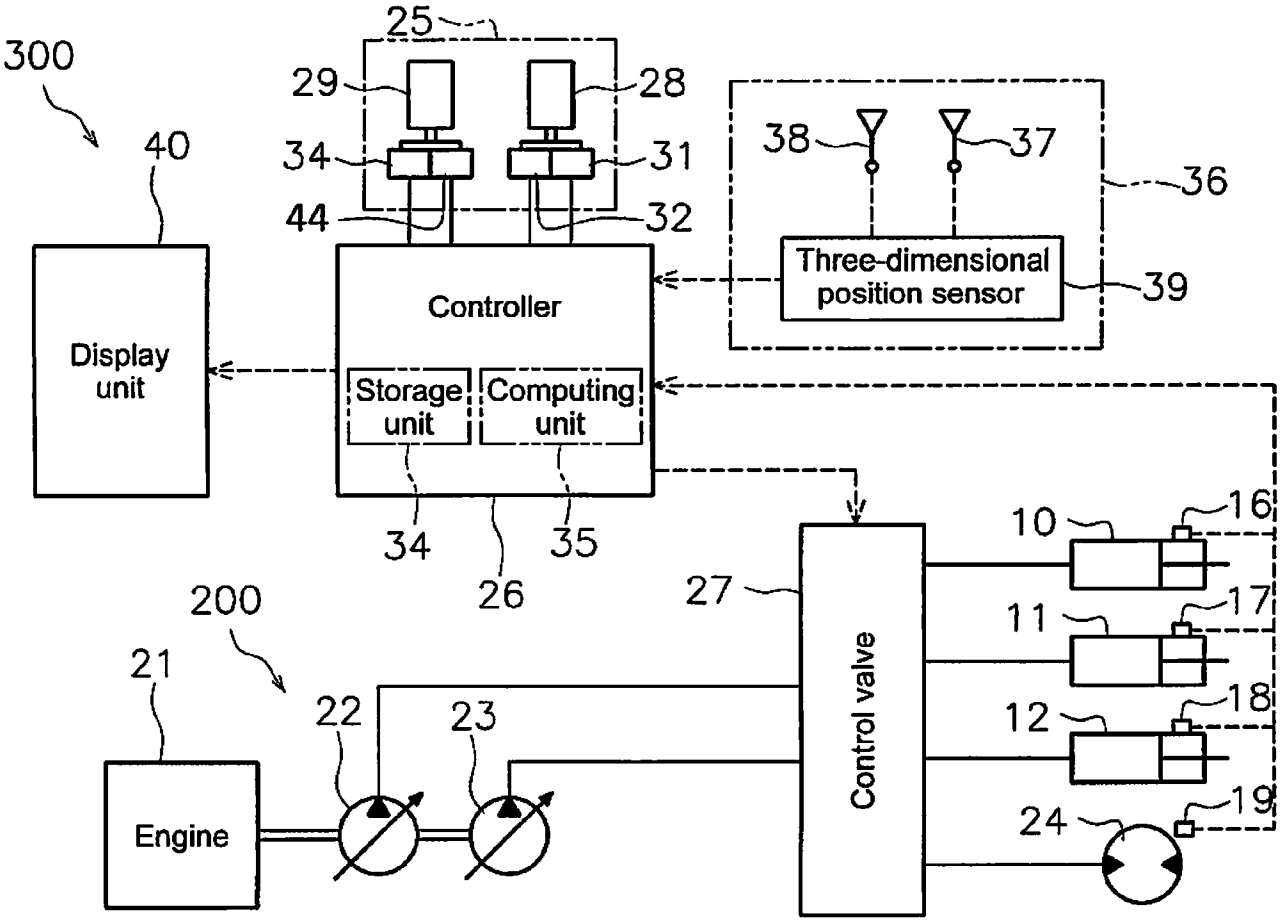
FIG. 2 is a block diagram illustrating a configuration of a control system provided in the hydraulic excavator.

FIG. 2 is a block diagram illustrating a configuration of a control system 300 and a drive system 200 provided in the hydraulic excavator 100. As illustrated in FIG. 2, the drive system 200 of the hydraulic excavator 100 is provided with an engine 21 and hydraulic pumps 22 and 23. The hydraulic pumps 22 and 23 are driven by the engine 21 to discharge hydraulic fluid. The boom cylinder 10, the arm cylinder 11, and the bucket cylinder 12 are driven by hydraulic fluid discharged from the hydraulic pumps 22 and 23. The hydraulic excavator 100 is provided with a revolution motor 24. The revolution motor 24 is a hydraulic motor and is driven by hydraulic fluid discharged from the hydraulic pumps 22 and 23. The revolution motor 24 turns the revolving body 3.

While two hydraulic pumps 22 and 23 are illustrated in FIG. 2, only one hydraulic pump may be provided. The revolution motor 24 is not limited to a hydraulic motor and may be an electric motor.

The control system 300 is provided with an operating device 25, a controller 26, and a control valve 27. The operating device 25 is a device for operating the work implement 2. The operating device 25 receives commands from an operator for driving the work implement 2 and outputs operation signals in accordance with an operation amount. The operating device 25 has a first operating member 28 and a second operating member 29.

The first operating member 28 is, for example, an operation lever. The first operating member 28 is provided in a manner that allows operation in the four directions of front, back, left, and right. Two of the four operating directions of the first operating member 28 are assigned to a raising operation and a lowering operation of the boom 6. The raising operation of the boom 6 corresponds to an excavation operation. The lowering operation of the boom 6 corresponds to a dump operation. The remaining two operating directions of the first operating member 28 are assigned to a raising operation and a lowering operation of the bucket 8.

The second operating member 29 is, for example, an operation lever. The second operating member 29 is provided in a manner that allows operation in the four directions of front, back, left, and right. Two of the four operating directions of the second operating member 29 are assigned to a raising operation and a lowering operation of the arm 7. The raising operation of the arm 7 corresponds to an excavation operation. The lowering operation of the arm 7 corresponds to a dump operation. The remaining two operating directions of the second operating member 29 are assigned to a right revolving operation and a left revolving operation of the revolving body 3.

The operating device 25 has a boom operating part 31 and a bucket operating part 32. The boom operating part 31 outputs a boom operation signal. The boom operation signal has a voltage value in accordance with an operation amount of the first operating member 28 (hereinbelow referred to as "boom operation amount") for operating the boom 6. The bucket operating part 32 outputs a bucket operation signal. The bucket operation signal has a voltage value in accordance with an operation amount of the first operating member 28 (hereinbelow referred to as "bucket operation amount") for operating the bucket 8.

The operating device 25 has an arm operating part 33 and a revolving operating part 44. The arm operating part 33 outputs an arm operation signal. The arm operation signal has a voltage value in accordance with an operation amount of the second operating member 29 for operating the arm 7 (hereinbelow referred to as "arm operation amount"). The revolving operating part 44 outputs a revolving operation signal. The revolving operation signal has a voltage value in accordance with an operation amount of the second operating member 29 for operating the revolution of the revolving body 3.

The controller 26 has a storage unit 34 such as a RAM or a ROM, and a computing unit 35 such as a CPU. The controller 26 obtains boom operation signals, arm operation signals, bucket operation signals, and revolution operation signals from the operating device 25. The controller 26 controls the control valve 27 on the basis of the operation signals.

The control valve 27 is an electromagnetic proportional control valve and is controlled by command signals from the controller 26. The control valve 27 is disposed between the hydraulic pumps 22 and 23 and hydraulic actuators such as the boom cylinder 10, the arm cylinder 11, the bucket cylinder 12, and the revolution motor 24. The control valve 27 controls the flow rate of the hydraulic fluid supplied from the hydraulic pumps 22 and 23 to the boom cylinder 10, the arm cylinder 11, the bucket cylinder 12, and the revolution motor 24.

The control system 300 has a first stroke sensor 16, a second stroke sensor 17, and a third stroke sensor 18. The first stroke sensor 16 detects a stroke length of the boom cylinder 10 (hereinbelow referred to as "boom cylinder length"). The second stroke sensor 17 detects a stroke length of the arm cylinder 11 (hereinbelow referred to as "arm cylinder length"). The third stroke sensor 18 detects a stroke length of the bucket cylinder 12 (hereinbelow referred to as "bucket cylinder length"). An angle sensor may be used for measuring the stroke. The control system 300 has a slope angle sensor 19. The slope angle sensor 19 is disposed on the revolving body 3. The slope angle sensor 19 detects a slope angle with respect to the horizontal direction of the revolving body 3, and a revolution angle of the revolving body 3 with respect to the front direction of the vehicle. The sensors send detection signals to the controller 26. The revolution angle may also be obtained from position information of below mentioned GNSS antennas 37 and 38.

The control system 300 is provided with a position detecting unit 36. The position detecting unit 36 detects a current position of the hydraulic excavator 100. The position detecting unit 36 has the GNSS antennas 37 and 38, and a three-dimensional position sensor 39. The plurality of the GNSS antennas 37 and 38 are provided on the revolving body 3. The GNSS antennas 37 and 38 are antennas for a Real-time Kinematic-Global Navigation Satellite System. Signals according to GNSS radio waves received by the GNSS antennas 37 and 38 are input into the three-dimensional position sensor 39.

Figure 3:
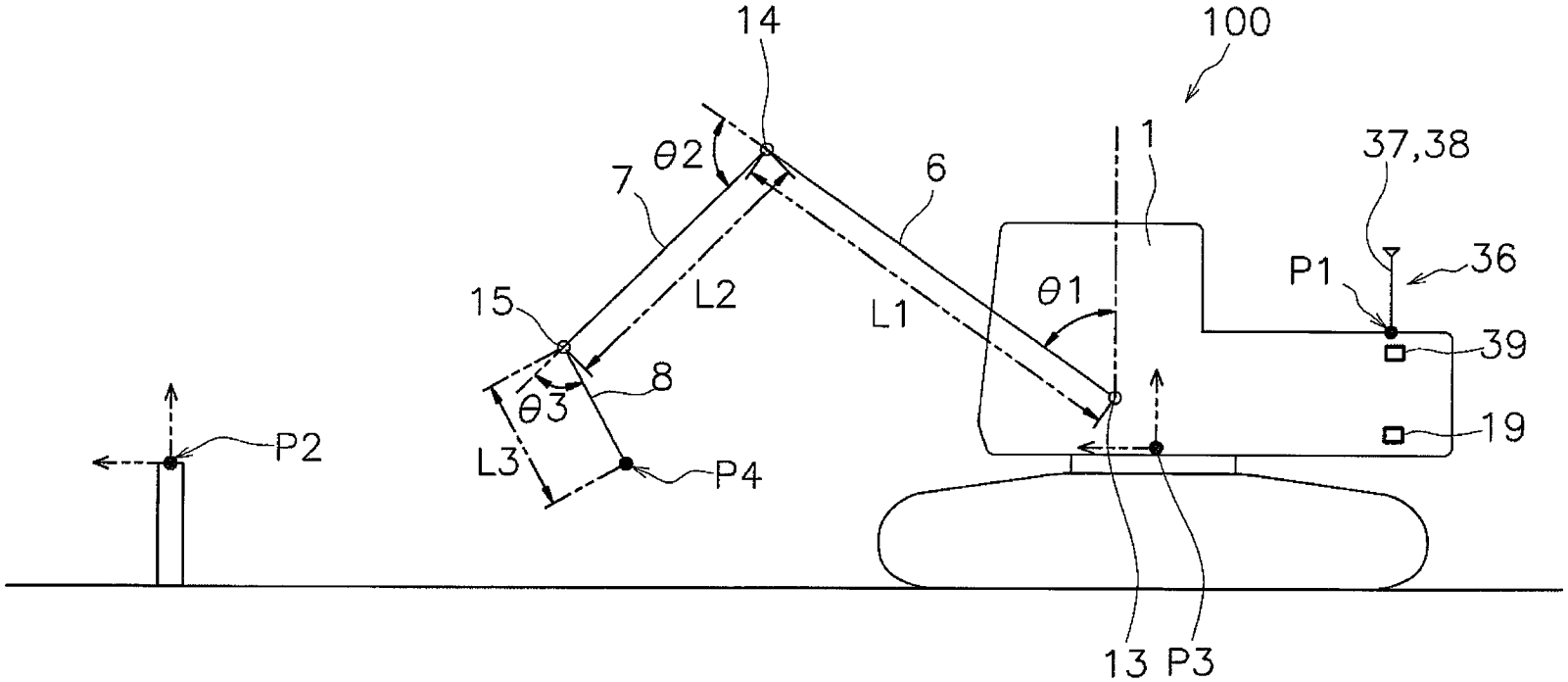
FIG. 3 is a side view schematically illustrating a configuration of the hydraulic excavator.

FIG. 3 is a side view schematically illustrating a configuration of the hydraulic excavator 100. The three-dimensional position sensor 39 detects an installation position P1 of the GNSS antennas 37 and 38 from a global coordinate system. The global coordinate system is a three-dimensional coordinate system based on a reference position P2 installed in a work area. As illustrated in FIG. 3, the reference position P2 is, for example, a position at the distal end of a reference marker set in the work area.

The controller 26 calculates a position of a local coordinate as seen in the global coordinate system on the basis of a detection result from the position detecting unit 36. A local coordinate system is a three-dimensional system based on the hydraulic excavator 100. A reference position P3 in the local coordinate system is, for example, a position on the center of revolution of the revolving body 3. Specifically, the controller 26 calculates a position of the local coordinates as seen in the global coordinate system as described below.

The controller 26 calculates a slope angle θ1 of the boom 6 with respect to the vertical direction in the local coordinate system from the boom cylinder length detected by the first stroke sensor 16. The controller 26 calculates a slope angle θ2 of the arm 7 with respect to the boom 6 from the arm cylinder length detected by the second stroke sensor 17. The controller 26 calculates a slope angle θ3 of the bucket 8 with respect to the arm 7 from the bucket cylinder length detected by the third stroke sensor 18.

The storage unit 34 in the controller 26 stores work implement data. The work implement data includes a length L1 of the boom 6, a length L2 of the arm 7, and a length L3 of the bucket 8. As illustrated in FIG. 3, the length L1 of the boom 6 corresponds to the length from the boom pin 13 to the arm pin 14. The length L2 of the arm 7 corresponds to the length from the arm pin 14 to the bucket pin 15. The length L3 of the bucket 8 corresponds to the length from bucket pin 15 to the distal end (hereinbelow referred to as "blade tip P4") of a tooth of the bucket 8. The work implement data includes position information of the boom pin 13 with respect to the reference position P3 in the local coordinate system.

The controller 26 calculates the position of the blade tip P4 in the local coordinate system from the slope angle θ1 of the boom 6, the slope angle θ2 of the arm 7, the slope angle θ3 of the bucket 8, the length L1 of the boom 6, the length L2 of the arm 7, the length L3 of the bucket 8, and the position information of the boom pin 13. The work implement data includes position information of the installation position P1 of the GNSS antennas 37 and 38 with respect to the reference position P3 in the local coordinate system. The controller 26 converts the position of the blade tip P4 in the local coordinate system to a position of the blade tip P4 in the global coordinate system based on the detection results of the position detecting unit 36 and the position information of the GNSS antennas 37 and 38. As a result, the controller 26 obtains the position information of the blade tip P4 as seen in the global coordinate system.

The storage unit 34 in the controller 26 stores design topography data indicating positions and shapes of a three-dimensional design topography inside the work area. The controller 26 displays the design topography on a display unit 40 on the basis of the design topography and detection results from the abovementioned sensors. The display unit 40 is, for example, a monitor and displays various types of information of the hydraulic excavator 100.

Figure 4:
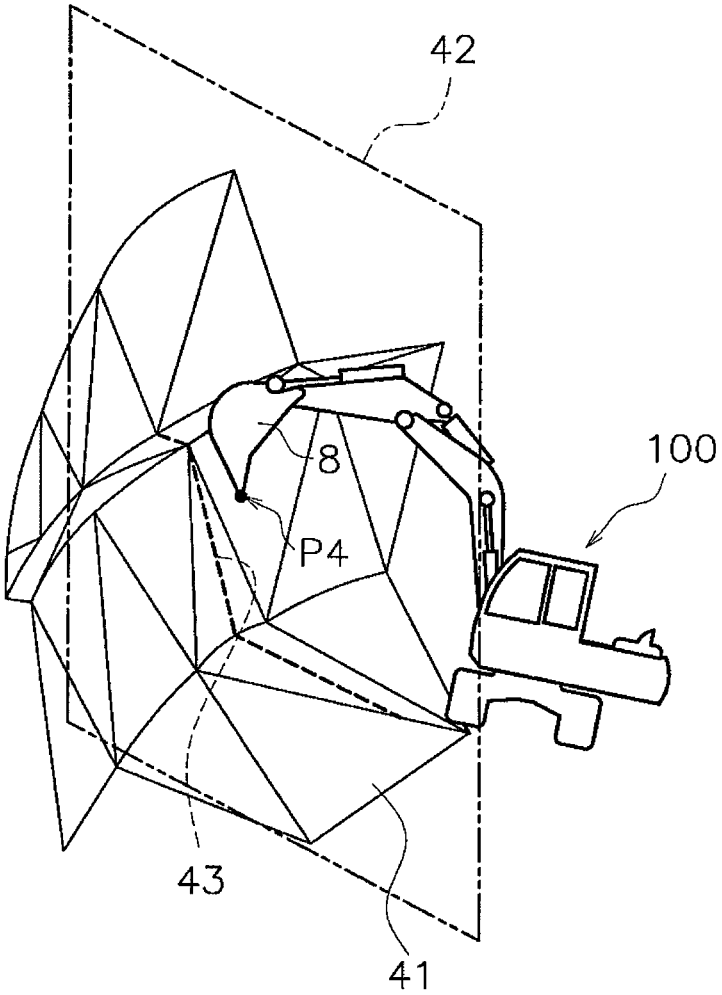
FIG. 4 is a schematic view of an example of a design topography.

FIG. 4 is a schematic view of an example of a design topography. As illustrated in FIG. 4, the design topography is configured by a plurality of design planes 41 that are each represented by triangular polygons. The plurality of design planes 41 represent a target shape to be excavated by the work implement 2. Only one of the plurality of design planes 41 is provided with the reference numeral 41 in FIG. 4, and reference numerals for the other design planes 41 are omitted.

Figure 5:
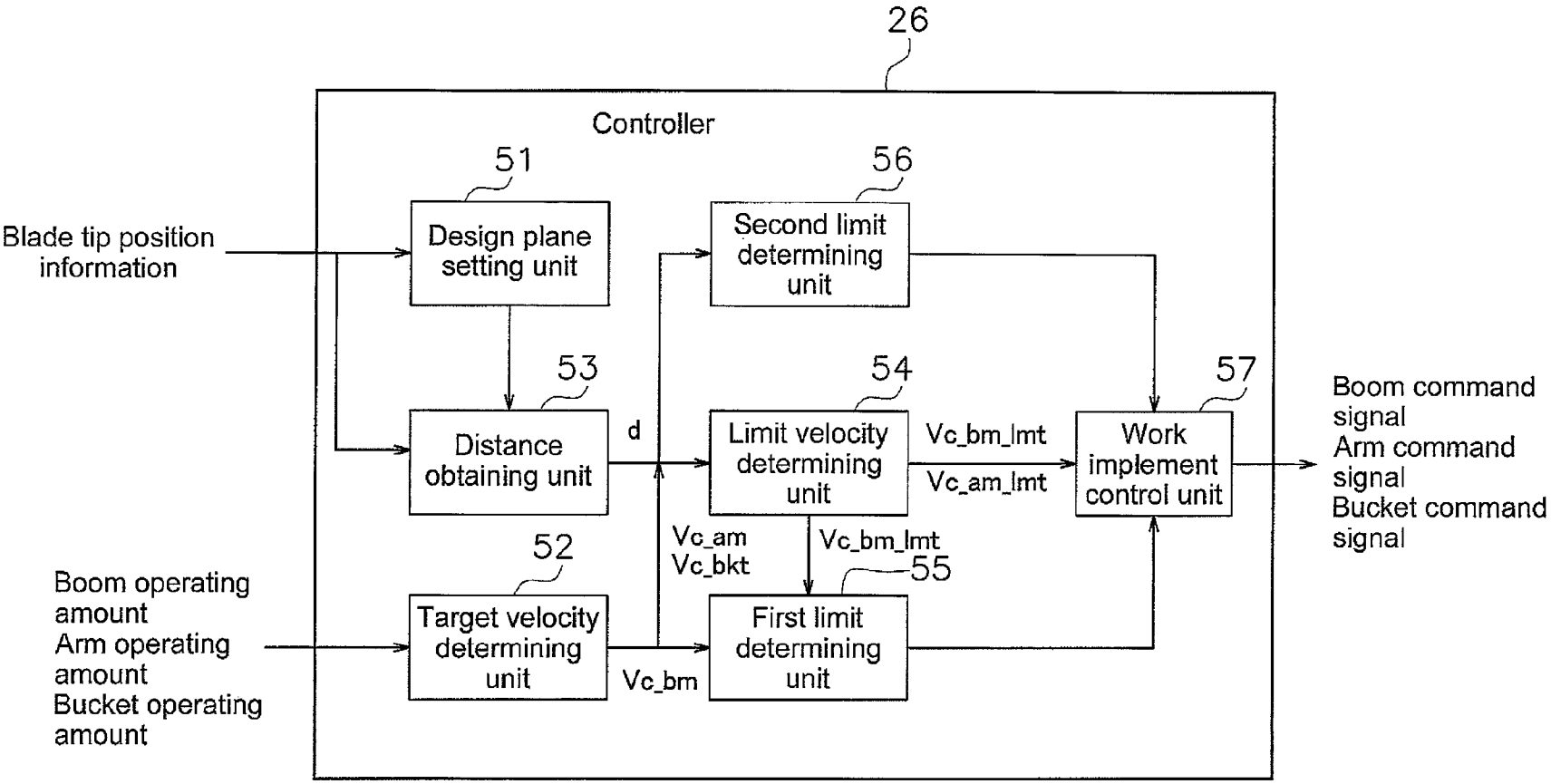
FIG. 5 is a block diagram of a configuration of a controller.

The controller 26 performs control by limiting the movement of the work implement 2 in order to prevent the bucket 8 from entering the design plane 41. The controls performed by the controller 26 are described in detail below. FIG. 5 is a block diagram of a configuration of a controller. The controller 26 has a design plane setting unit 51, a target velocity determining unit 52, a distance obtaining unit 53, a limit velocity determining unit 54, a first limit determining unit 55, a second limit determining unit 56, and a work implement control unit 57.

The design plane setting unit 51 sets the design plane 41 for indicating the target shape to be excavated. Specifically, the design plane setting unit 51 selects a portion of the design planes 41 among the abovementioned plurality of design planes 41 as a target design plane. For example, the design plane setting unit 51 sets an intersection between the design plane 41 and a perpendicular line passing through the current position of the blade tip P4 in the global coordinate system, as position to be excavated. The design plane setting unit 51 selects the design plane 41 including the position to be excavated and the design planes 41 positioned therebefore and thereafter, as a plane to be excavated. The design plane setting unit 51 sets an intersecting line 43 that intersects the plane to be excavated and a flat plane 42 that passes through the current position of the blade tip P4 of the bucket 8, as the target design plane.

Figure 6:
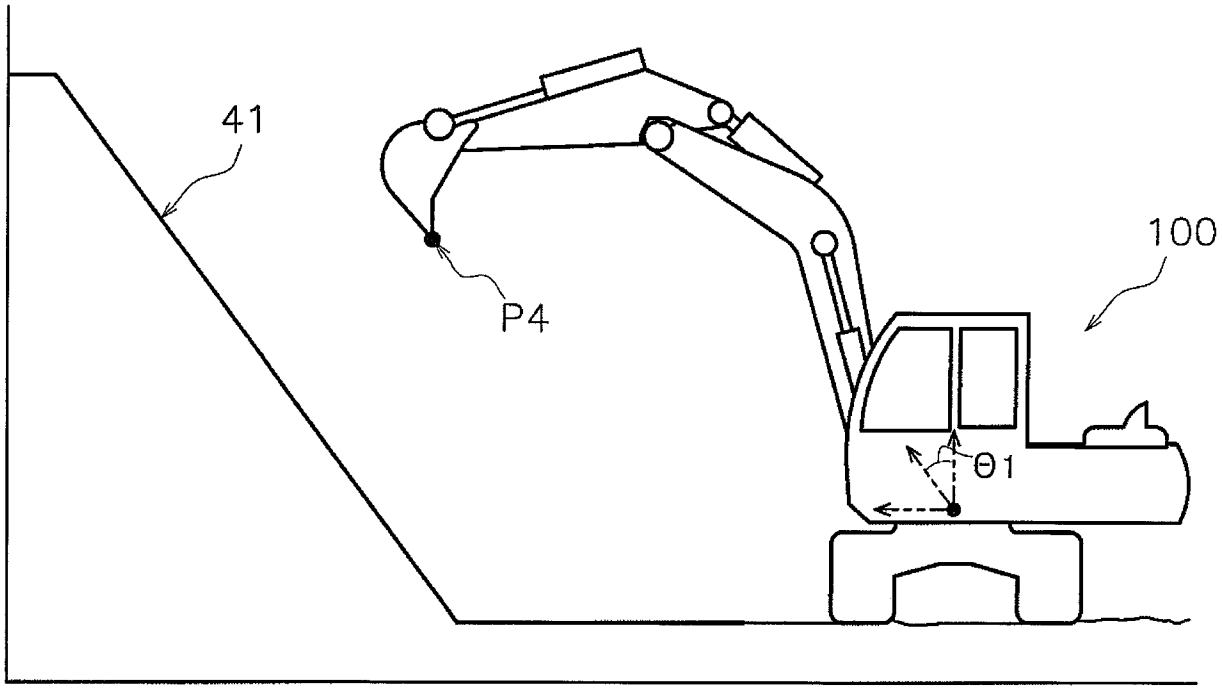
FIG. 6 illustrates an example of a design plane.

In the following explanation, the design plane 41 refers to the target design plane set as described above. FIG. 6 illustrates an example of a set design plane 41. The controller 26 displays an image indicating a positional relationship between the set design plane 41 and the current position of the blade tip P4, on the display unit 40.

The target velocity determining unit 52 determines a boom target velocity Vc_bm, an arm target velocity Vc_am, and a bucket target velocity Vc_bkt. The boom target velocity Vc_bm is a velocity of the blade tip P4 when only the boom cylinder 10 is being driven. The arm target velocity Vc_am is a velocity of the blade tip P4 when only the arm cylinder 11 is being driven. The bucket target velocity Vc_bkt is a velocity of the blade tip P4 when only the bucket cylinder 12 is being driven. The boom target velocity Vc_bm is calculated in accordance with the boom operation amount. The arm target velocity Vc_am is calculated in accordance with the arm operation amount. The bucket target velocity Vc_bkt is calculated in accordance with the bucket operation amount.

The storage unit 34 stores target velocity information for prescribing a relationship between the boom operation amount and the boom target velocity Vc_bm. The target velocity determining unit 52 determines the boom target velocity Vc_bm corresponding to the boom operation amount by referencing the target velocity information. The target velocity information is, for example, a graph. The target velocity information may be in a format such as a table or an equation. The target velocity information includes information prescribing the relationship between the arm operation amount and the arm target velocity Vc_am. The target velocity information includes information prescribing the relationship between the bucket operation amount and the bucket target velocity Vc_bkt. The target velocity determining unit 52 determines the arm target velocity Vc_am corresponding to the arm operation amount by referencing the target velocity information. The target velocity determining unit 52 determines the bucket target velocity Vc_bkt corresponding to the bucket operation amount by referencing the target velocity information.

Figure 7:
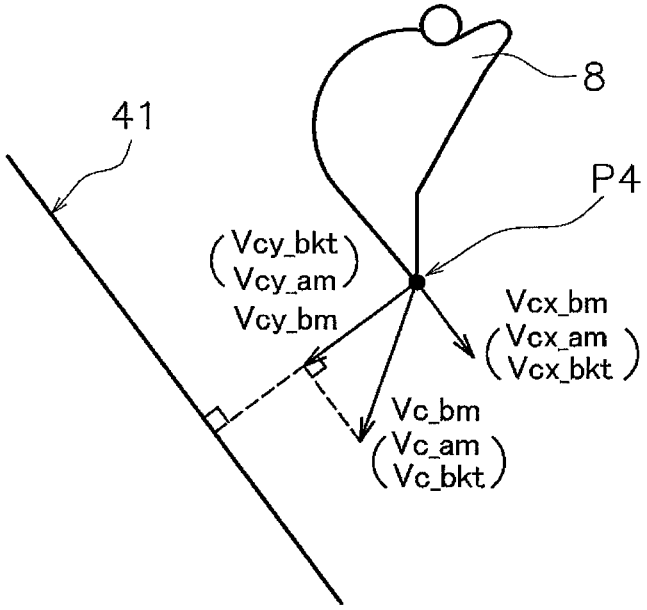
FIG. 7 is a schematic view illustrating a relationship between a target velocity, a vertical velocity component, and a horizontal velocity component.

As illustrated in FIG. 7, the target velocity determining unit 52 converts the boom target velocity Vc_bm to a velocity component (hereinbelow referred to as "vertical velocity component") Vcy_bm in a direction perpendicular to the design plane 41 and a velocity component (hereinbelow referred to as "horizontal velocity component") Vcx_bm in a direction parallel to the design plane 41.

Specifically, the target velocity determining unit 52 first finds the slope of the vertical axis of the local coordinates with respect to the vertical axis of the global coordinates and the slope in the vertical direction of the design plane 41 with respect to the vertical axis of the global coordinates, from the design topography data and the position information of the GNSS antennas 37 and 38, and then, from the slopes, finds the slope θ1 (see FIG. 6) of the vertical axis of the local coordinates and the vertical direction of the design plane 41.

Figure 8:
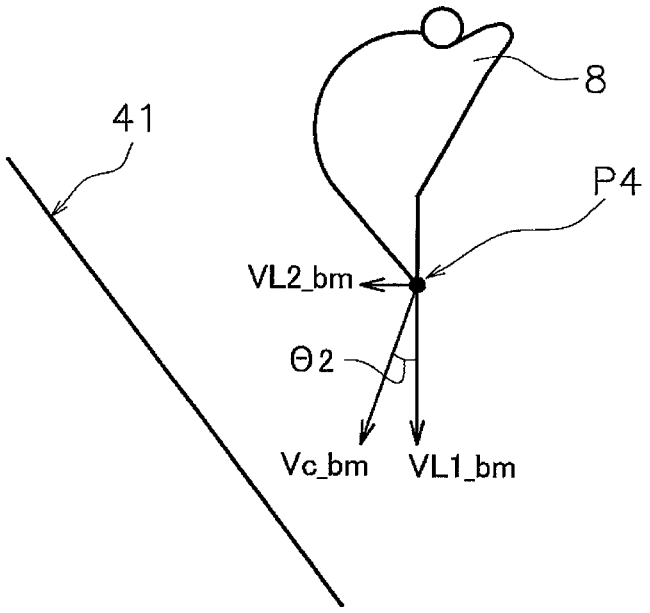
FIG. 8 illustrates a method for calculating the vertical velocity component and the horizontal velocity component.
Figure 9:
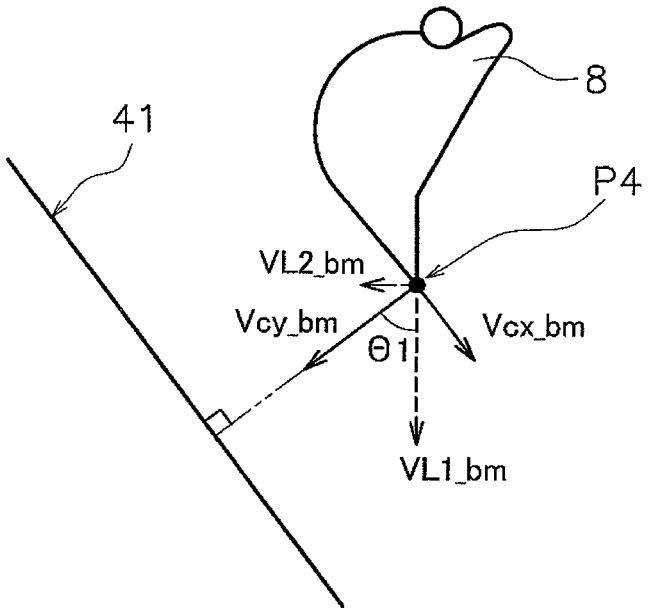
FIG. 9 illustrates a method for calculating the vertical velocity component and the horizontal velocity component.

As illustrated in FIG. 8, the target velocity determining unit 52 then uses a trigonometric function to convert the boom target velocity Vc_bm to a velocity component VL1_bm in the vertical axis direction and a velocity component VL2_bm in the horizontal axis direction of the local coordinates, from an angle θ2 between the vertical axis of the local coordinates and the direction of the boom target velocity Vc_bm. As illustrated in FIG. 9, the target velocity determining unit 52 then uses a trigonometric function to convert the velocity component VL1_bm in the vertical axis direction and the velocity component VL2_bm in the horizontal axis direction to the abovementioned vertical velocity component Vcy_bm and the horizontal velocity component Vcx_bm with respect to the design plane 41, from the abovementioned slope θ1 of the vertical direction of the design plane 41 and the vertical axis of the local coordinates. Similarly, the target velocity determining unit 52 converts the arm target velocity Vc_am to a vertical velocity component Vcy_am and a horizontal velocity component Vcx_am. The target velocity determining unit 52 converts the bucket target velocity Vc_bkt to the vertical velocity component Vcy_bkt and the horizontal velocity component Vcx_bkt.

Figure 10:
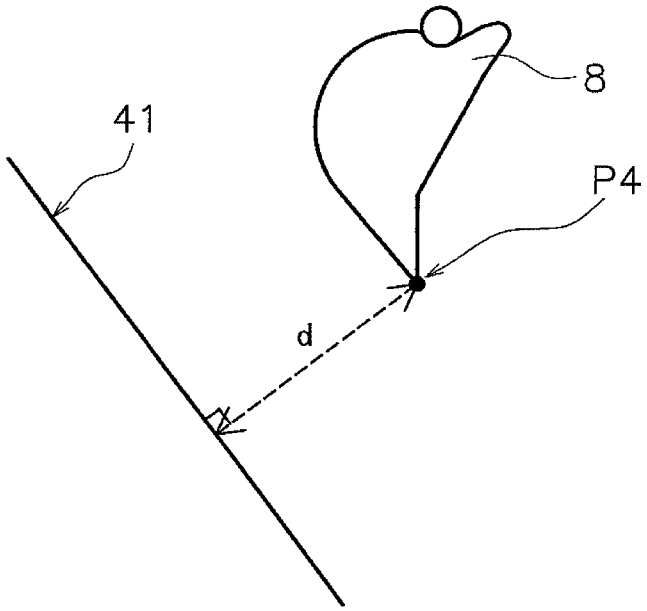
FIG. 10 is a schematic view of the distance between the blade tip and the design plane.

As illustrated in FIG. 10, the distance obtaining unit 53 obtains a distance between the blade tip P4 of the bucket 8 and the design plane 41. Specifically, the distance obtaining unit 53 calculates a distance d that is the shortest distance between the blade tip P4 of the bucket 8 and the design plane 41 from the position information of the blade tip P4 obtained as described above and from the design topography data that indicates the position of the design plane 41.

The limit velocity determining unit 54 calculates a limit velocity Vcy_lmt of the entire work implement 2 on the basis of the distance d between the blade tip P4 of the bucket 8 and the design plane 41. The limit velocity Vcy_lmt for the entire work implement 2 is an allowable movement velocity of the blade tip P4 in the direction in which the blade tip P4 of the bucket 8 approaches the design plane 41. The storage unit 34 stores the limit velocity information that prescribes the relationship between the distance d and the limit velocity Vcy_lmt.

Figure 11:
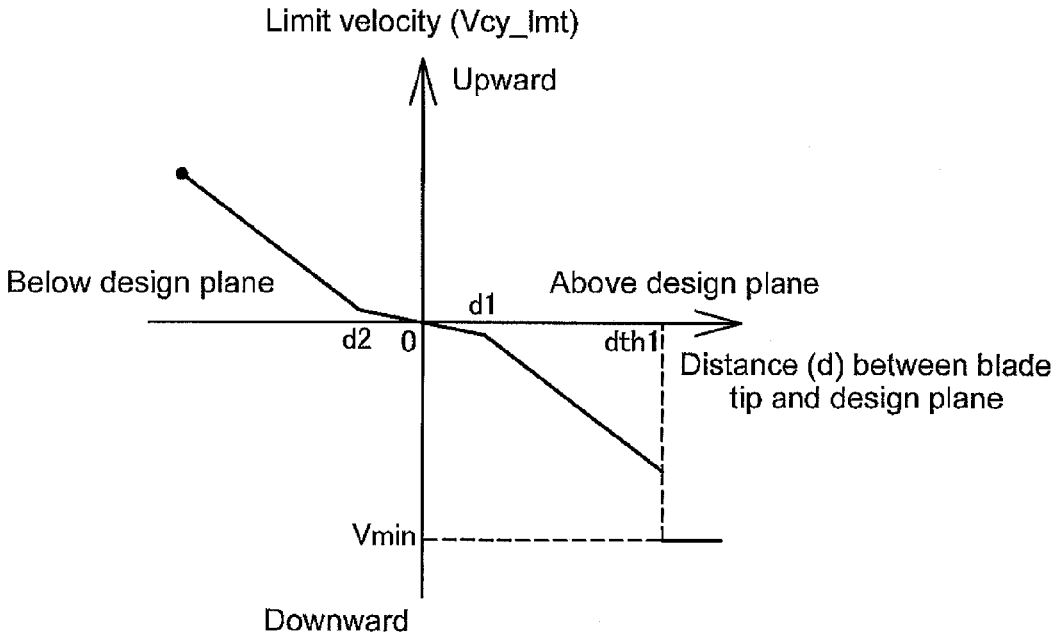
FIG. 11 is a graph of an example of limit velocity information.

FIG. 11 is an example of the limit velocity information. In FIG. 11, the distance d is a positive value when the blade tip P4 is positioned outside the design plane 41, and is a negative value when the blade tip P4 is positioned inside the design plane 41. In other words, the distance d is a positive value when the blade tip P4 is positioned above the design plane 41, and is a negative value when the blade tip P4 is positioned below the design plane 41 as illustrated in FIG. 10 for example. That is to say, the distance d is a positive value when the blade tip P4 does not enter the design plane 41 and is a negative value when the blade tip P4 enters the design plane 41. The distance d is 0 when the blade tip P4 is on the design plane 41.

The velocity when the blade tip P4 moves from the inside toward the outside of the design plane 41 is a positive value, and the velocity when the blade tip P4 moves from the outside toward the inside of the design plane 41 is a negative value. In other words, the velocity when the blade tip P4 moves toward a position above the design plane 41 is a positive value and the velocity when the blade tip P4 moves toward a position below the design plane 41 is a negative value.

In the limit velocity information, the slope of the limit velocity Vcy_lmt when the distance d is between d1 and d2 is smaller than the slopes when the distance d is at or above d1 or at or below d2. d1 is greater than 0. d2 is less than 0. Since the limit velocity is set in more detail for operations near the design plane 41, the slope when the distance d is between d1 and d2 is smaller than the slopes when the distance d is at or above d1 or at or below d2. When the distance d is equal to or greater than d1, the limit velocity Vcy_lmt is a negative value, and the limit velocity Vcy_lmt becomes correspondingly smaller as the distance d increases. In other words, when the distance d is equal to or greater than d1, the velocity toward a position below the design plane 41 becomes correspondingly larger and the absolute value of the limit velocity Vcy_lmt correspondingly increases as the blade tip P4 above the design plane 41 is further away from the design plane 41. When the distance d is equal to or less than 0, the limit velocity Vcy_lmt is a positive value, and the limit velocity Vcy_lmt becomes correspondingly larger as the distance d decreases. In other words, when the distance d when the blade tip P4 of the bucket 8 moves away from the design plane 41 is equal to or less than 0, the velocity heading upward to the design plane 41 becomes correspondingly larger and the absolute value of the limit velocity Vcy_lmt correspondingly increases as the blade tip P4 below the design plane 41 is further away from the design plane 41.

When the distance d is equal to or greater than a first predetermined value dth1, the limit velocity Vcy_lmt becomes Vmin. The first predetermined value dth1 is a positive value and is greater than d1. Vmin is smaller than the minimum value of the target velocity. In other words, when the distance d is equal to or greater than the first predetermined value dth1, limitation of the operation of the work implement 2 is not performed. Therefore, limitation of the operation of the work implement 2 is not performed when the blade tip P4 is far away from the design plane 41 above the design plane 41. In other words, when the distance d is less than the first predetermined value dth1, limitation of the operation of the work implement 2 is performed. Specifically, when the distance d is less than the first predetermined value dth1, the operation of the boom 6 is limited as described below.

Figure 12:
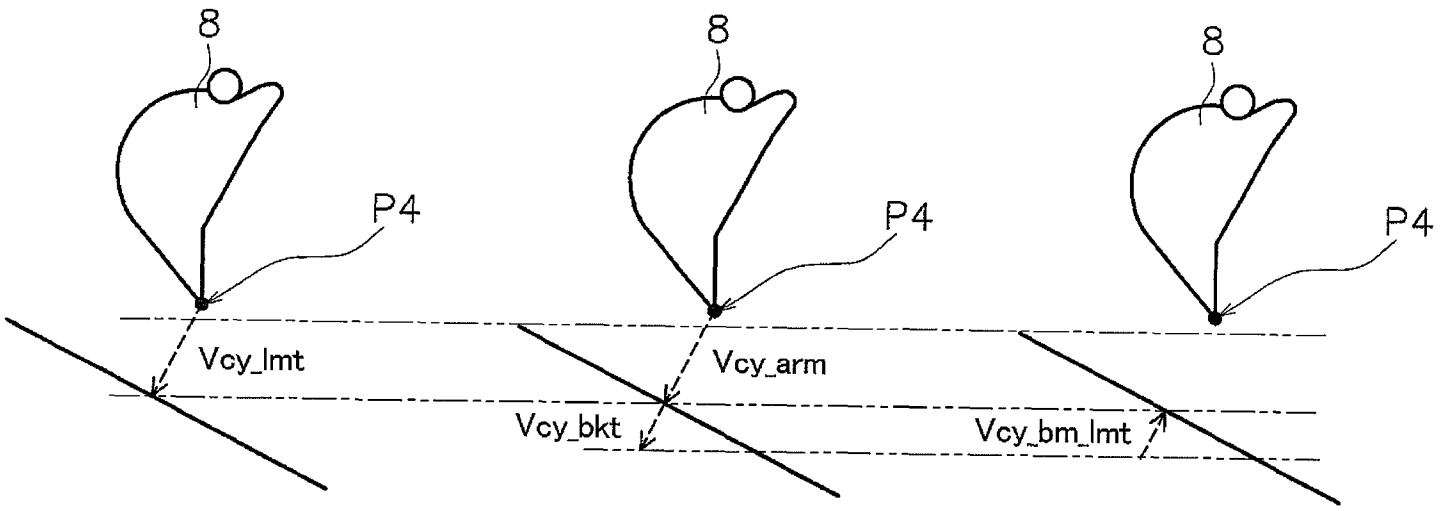
FIG. 12 is a schematic view of a method for calculating the vertical velocity component of a limit velocity of the boom.

The limit velocity determining unit 54 calculates the vertical velocity component (hereinbelow referred to as "boom 6 limit vertical velocity component") Vcy_bm_lmt of the limit velocity of the boom 6 from the limit velocity Vcy_lmt of the entire work implement 2, the arm target velocity Vc_am, and the bucket target velocity Vc_bkt. As illustrated in FIG. 12, the limit velocity determining unit 54 calculates the limit vertical velocity component Vcy_bm_lmt of the boom 6 by subtracting the vertical velocity component Vcy_am of the arm target velocity and the vertical velocity component Vcy_bkt of the bucket target velocity, from the limit velocity Vcy_lmt of the entire work implement 2.

Figure 13:
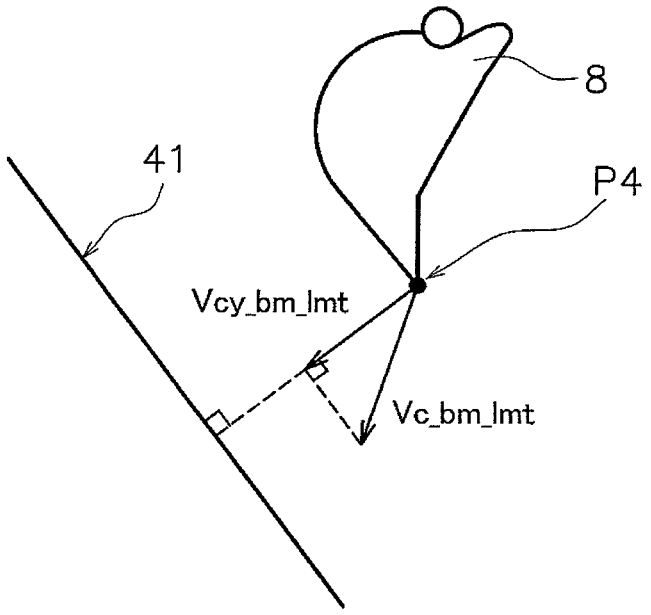
FIG. 13 is a schematic view of a relationship between the limit velocity of the boom and the vertical velocity component of the limit velocity of the boom.

As illustrated in FIG. 13, the limit velocity determining unit 54 also converts the limit vertical velocity component Vcy_bm_lmt of the boom 6 to a limit velocity Vc_bm_lmt of the boom 6. The limit velocity determining unit 54 finds the relationship between the direction perpendicular to the design plane 41 and the direction of the limit velocity Vc_bm_lmt of the boom 6 from the abovementioned slope angle θ1 of the boom 6, the slope angle θ2 of the arm 7, the slope angle θ3 of the bucket 8, the position information of the GNSS antennas 37 and 38, and the design topography data, and converts the limit vertical velocity component Vcy_bm_lmt of the boom 6 to the limit velocity Vc_bm_lmt of the boom 6. The calculation in this case is performed in an order reverse to the order when finding the velocity Vcy_bm in the direction perpendicular to the design plane 41 from the previously described boom target velocity Vc_bm.

The first limit determining unit 55 is a unit for determining a condition for limiting the boom 6 and determines whether or not a first limit condition is satisfied. The first limit condition includes the conditions of the distance d being smaller than the abovementioned first predetermined value dth1, the distance d being equal to or greater than a below mentioned second predetermined value dth2, and the limit velocity Vc_bm_lmt of the boom 6 being larger than the boom target velocity Vc_bm. For example, when lowering the boom 6, when the size of the downward limit velocity Vc_bm_lmt of the boom 6 is smaller than the size of the downward boom target velocity Vc_bm, the first limit determining unit 55 determines the first limit condition to be satisfied. When raising the boom 6, when the size of the upward limit velocity Vc_bm_lmt of the boom 6 is larger than the size of the upward boom target velocity Vc_bm, the first limit determining unit 55 determines the first limit condition to be satisfied.

The second limit determining unit 56 is a unit for determining a condition for limiting the arm 7 and determines whether or not the second limit condition is satisfied. The second limit condition includes the conditions of the distance d between the blade tip P4 and the design plane 41 being smaller than the second predetermined value dth2, and the limit velocity Vc_bm_lmt of the boom 6 being larger than the boom target velocity Vc_bm. The second predetermined value is 0. Therefore, when the blade tip P4 is positioned outside of the design plane 41, the second limit determining unit 56 determines the second limit condition to not be satisfied. That is, when the blade tip P4 is positioned above the design plane 41, the second limit determining unit 56 determines the second limit condition not to be satisfied. When the blade tip P4 is positioned inside of the design plane 41, the second limit determining unit 56 determines the second limit condition to be satisfied. That is, when the blade tip P4 is positioned below the design plane 41, the second limit determining unit 56 determines the second limit condition to be satisfied.

Figure 14:
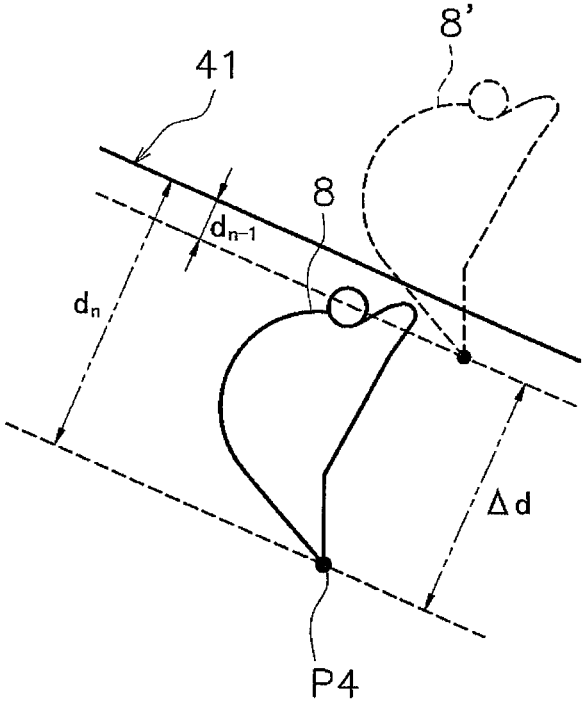
FIG. 14 is a schematic view of a deviation amount and a displacement amount of the blade tip.

The second limit condition further includes the condition that a current deviation amount is larger than a previous deviation amount. As illustrated in FIG. 14, the distance obtaining unit 53 obtains a deviation amount of the blade tip P4 of the bucket 8 with respect to the design plane 41 at predetermined time intervals. A current deviation amount $d_n$ is an absolute value of the distance d between the design plane 41 and the blade tip P4 of the bucket 8 inside the design plane 41. In FIG. 14, a bucket 8' represents a position of the bucket 8 when sampling a previous deviation amount $d_{n-1}$. The fact that the current deviation amount $d_n$ is greater than the previous deviation amount $d_{n-1}$ signifies the fact that the blade tip P4 is increasing the entry into the design plane 41. The second limit determining unit 56 determines the second limit condition to be satisfied during entry when the distance d between the blade tip P4 and the design plane 41 is less than 0 and when the current deviation amount $d_n$ is greater than the previous deviation amount $d_{n-1}$.

When the current deviation amount $d_n$ is equal to or less than the previous deviation amount $d_{n-1}$, the second limit determining unit 56 determine the second limit condition not to be satisfied. Therefore, when entry of the blade tip P4 in the design plane 41 is not increasing even when the blade tip P4 is positioned below the design plane 41, the second limit determining unit 56 determines the second limit condition not to be satisfied.

The work implement control unit 57 controls the work implement 2. The work implement control unit 57 controls the boom cylinder 10, the arm cylinder 11, and the bucket cylinder 12 by sending arm command signals, boom command signals, and bucket command signals to the control valve 27. The arm command signals, boom command signals, and bucket command signals have electric current values that respectively correspond to a boom command velocity, an arm command velocity, and a bucket command velocity.

During normal driving when neither the first limit condition nor the second limit condition is satisfied, the work implement control unit 57 selects the boom target velocity Vc_bm, the arm target velocity Vc_am, and the bucket target velocity Vc_bkt respectively as the boom command velocity, the arm command velocity, and the bucket command velocity. That is, during normal driving, the work implement control unit 57 actuates the boom cylinder 10, the arm cylinder 11, and the bucket cylinder 12 in accordance with the boom operation amount, the arm operation amount, and the bucket operation amount respectively. Therefore, the boom cylinder 10 is operated at the boom target velocity Vc_bm, the arm cylinder 11 is operated at the arm target velocity Vc_am, and the bucket cylinder 12 is operated at the bucket target velocity Vc_bkt.

When the first limit condition is satisfied, the work implement control unit 57 actuates the boom 6 at the limit velocity Vc_bm_lmt of the boom 6 and actuates the arm 7 at the arm target velocity Vc_am. The work implement control unit 57 actuates the bucket 8 at the bucket target velocity Vc_bkt.

As described above, the limit vertical velocity component Vcy_bm_lmt of the boom 6 is calculated by subtracting the vertical velocity component Vcy_am of the arm target velocity and the vertical velocity component Vcy_bkt of the bucket target velocity, from the limit velocity Vcy_lmt of the entire work implement 2. Therefore, the limit vertical velocity component Vcy_bm_lmt of the boom 6 becomes a negative value for raising the boom 6 when the limit velocity Vcy_lmt of the entire work implement 2 is smaller than the sum of the vertical velocity component Vcy_am of the arm target velocity and the vertical velocity component Vcy_bkt of the bucket target velocity.

Therefore, the limit velocity Vc_bm_lmt of the boom 6 becomes a negative value. In this case, the work implement control unit 57 reduces the velocity of the lowering of the boom 6 to a velocity below the boom target velocity Vc_bm. As a result, the bucket 8 is prevented from entering the design plane 41 while reducing the discomfort felt by the operator.

The limit vertical velocity component Vcy_bm_lmt of the boom 6 becomes a positive when the limit velocity Vcy_lmt of the entire work implement 2 is greater than the sum of the vertical velocity component Vcy_am of the arm target velocity and the vertical velocity component Vcy_bkt of the bucket target velocity. Therefore, the limit velocity Vc_bm_lmt of the boom 6 becomes a positive value. In this case, the work implement control unit 57 raises the boom 6 even if the operating device 25 is operated in the direction for lowering the boom 6. As a result, an increase of the entry into the design plane 41 can be quickly suppressed.

When the blade tip P4 is positioned above the design plane 41, the absolute value of the limit vertical velocity component Vcy_bm_lmt of the boom 6 becomes correspondingly smaller and an absolute value of a velocity component (hereinbelow referred to as "limit horizontal velocity component") Vcx_bm_lmt of the limit velocity of the boom 6 in the direction parallel to the design plane 41 becomes correspondingly smaller, as the blade tip P4 moves closer to the design plane 41. Therefore, when the blade tip P4 is positioned above the design plane 41, both the velocity of the boom 6 in the direction perpendicular to the design plane 41 and the velocity of the boom 6 in the direction parallel to the design plane 41, are reduced as the blade tip P4 moves closer to the design plane 41.

Figure 15:
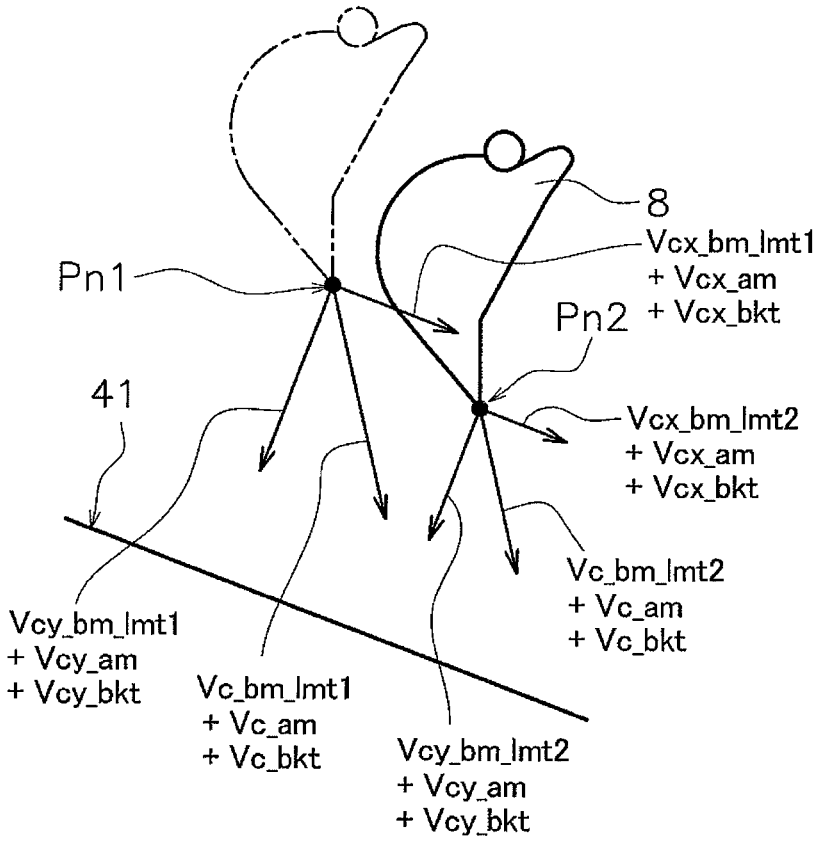
FIG. 15 illustrates an example of a change in the limit velocity of the boom due to movement of the blade tip.

The boom 6, the arm 7, and the bucket 8 may be operated at the same time due to the operator operating the first operating member 28 and the second operating member 29 at the same time. The following is a description of the above controls when the respective limit velocities Vc_bm, Vc_am, and Vc_bkt of the boom 6, the arm 7, and the bucket 8 are inputted. FIG. 15 illustrates an example of a change in the limit velocity of the boom 6 when the distance d between the design plane 41 and the bucket blade tip P4 is smaller than the first predetermined value dth1, and the blade tip P4 of the bucket 8 moves from a position Pn1 to a position Pn2. The distance between the blade tip P4 at the position Pn2 and the design plane 41 is smaller than the distance between the blade tip P4 at the position Pn1 and the design plane 41. As a result, a limit vertical velocity component Vcy_bm_lmt2 of the boom 6 at the position Pn2 is smaller than a limit vertical velocity component Vcy_bm_lmt1 of the boom 6 at the position Pn1. Therefore, the limit velocity Vc_bm_lmt2 of the boom 6 at the position Pn2 becomes smaller than the limit velocity Vc_bm_lmt1 of the boom 6 at the position Pn1. Further, a limit horizontal velocity component Vcx_bm_lmt2 of the boom 6 at the position Pn2 becomes smaller than the limit horizontal velocity component Vcx_bm_lmt1 of the boom 6 at the position Pn1. At this time, however, limitation of the arm target velocity Vc_am and the bucket target velocity Vc_bkt is not performed. As a result, the vertical velocity component Vcy_am and the horizontal velocity component Vcx_am of the arm target velocity, and the vertical velocity component Vcy_bkt and the horizontal velocity component Vcx_bkt of the bucket target velocity are not limited.

As described above, by not performing the limitation of the arm 7, a change of the arm operation amount corresponding to the intended excavation by the operator is reflected as a velocity change of the blade tip P4 of the bucket 8. As a result, a feeling of discomfort in the operation when the operator is excavating can be suppressed while preventing an increase of the entry into the design plane 41.

When the second limit condition is satisfied, the work implement control unit 57 controls the boom 6 at the limit velocity Vc_bm_lmt of the boom 6, and controls the arm 7 at an arm limit velocity Vc_am_lmt. The limit velocity determining unit 54 calculates the arm limit velocity Vc_am_lmt by multiplying the arm target velocity Vc_am by an arm deceleration coefficient. The limit velocity determining unit 54 calculates the arm deceleration coefficient a using the following equation (1).

$$a=1+0.001\times(D_n+(D_n-D_{n-1})\times b) \qquad \text{Equation (1)}$$

where b is a predetermined constant, $D_n$ is a current excavation amount, and $D_{n-1}$ is a previously obtained excavation amount. The absolute value of the excavation amount $D_n$ corresponds to the abovementioned deviation amount $d_n$, and the excavation amount $D_n$ is a negative value inside the design plane 41. The term "$D_n-D_{n-1}$" in Equation (1) corresponds to a displacement amount Δd between the previous position and the current position of the blade tip P4 of the bucket 8. Therefore, the limit velocity determining unit 54 calculates the arm deceleration coefficient on the basis of the current deviation amount $d_n$ and the displacement amount Δd between the previous position and the current position of the blade tip P4 of the bucket 8.

The arm deceleration coefficient is a value greater than 0 and smaller than 1. Therefore, the absolute value of the arm limit velocity Vc_am_lmt is smaller than the absolute value of the arm target velocity Vc_am. That is, when the second limit condition is satisfied, the work implement control unit 57 reduces the velocity of the arm 7 to a velocity lower than the arm target velocity Vc_am. Therefore, when the second limit condition is satisfied, the work implement control unit 57 reduces the velocity of the boom 6 to a velocity lower than the boom target velocity Vc_bm or raises the boom 6, and reduces the velocity of the arm 7 to a velocity lower than the arm target velocity Vc_am.

Figure 16:
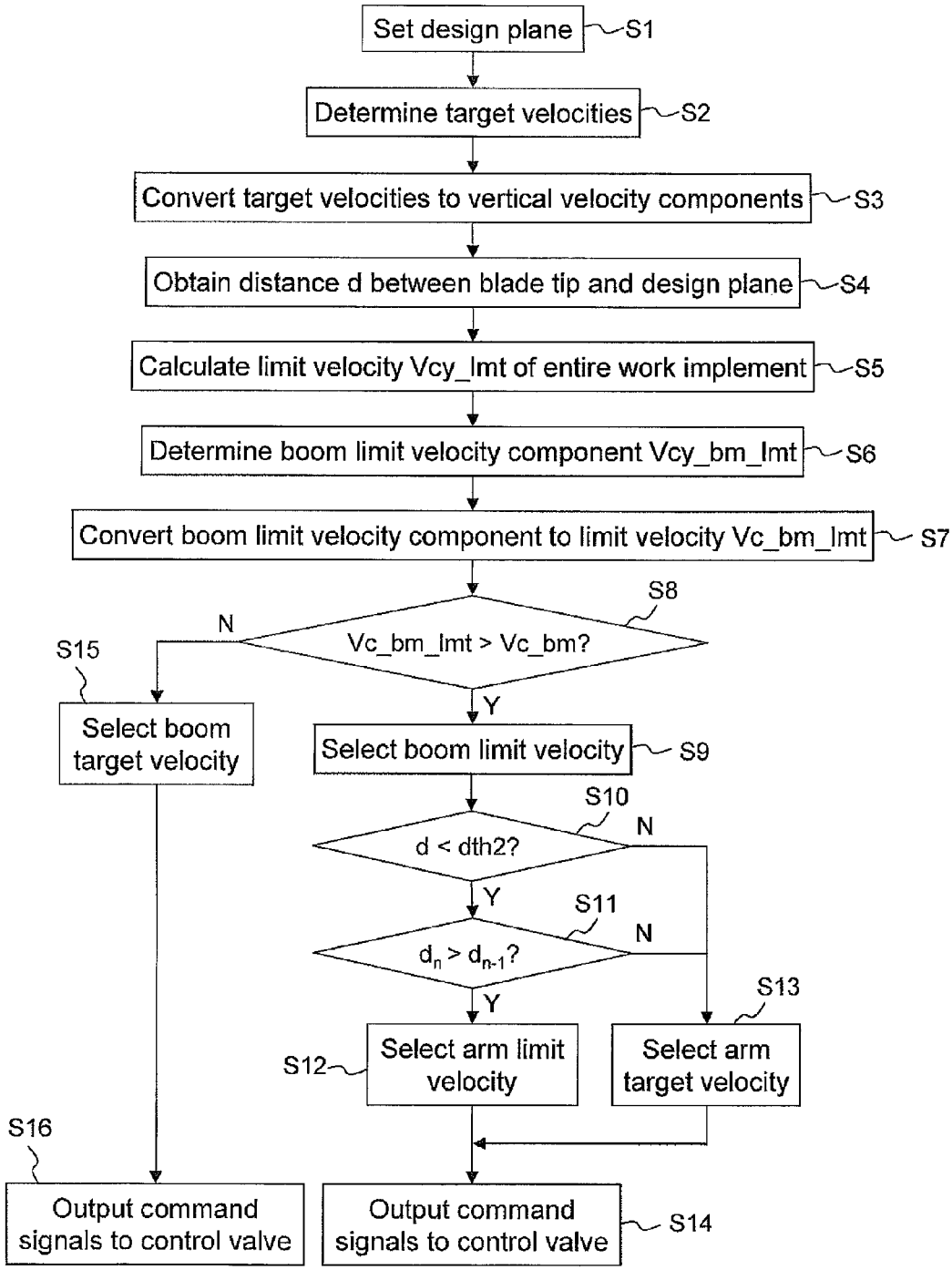
FIG. 16 is a flow chart describing control by the control system.

FIG. 16 is a flow chart illustrating controls performed by the control system 300. The order of the processes in the flow chart is not limited to the order described below and may be modified.

The design plane 41 is set in step S1. The boom target velocity Vc_bm, the arm target velocity Vc_am, and the bucket target velocity Vc_bkt are respectively determined from the boom operation amount, the arm operation amount, and the bucket operation amount in step S2. The boom target velocity Vc_bm, the arm target velocity Vc_am, and the bucket target velocity Vc_bkt are each converted to vertical velocity components in step S3.

The distance d between the blade tip P4 of the bucket 8 and the design plane 41 is obtained in step S4. The limit velocity Vcy_lmt of the entire work implement 2 is calculated on the basis of the distance d in step S5. The limit vertical velocity component Vcy_bm_lmt of the boom 6 is calculated from the limit velocity Vcy_lmt of the entire work implement 2, the arm target velocity Vc_am, and the bucket target velocity Vc_bkt in step S6. The limit vertical velocity component Vcy_bm_lmt of the boom 6 is converted to the limit velocity Vc_bm_lmt of the boom 6 in step S7.

Whether or not the limit velocity Vc_bm_lmt of the boom 6 is larger than the boom target velocity Vc_bm is determined in step S8. If the determination in step S8 is Yes and the limit velocity Vc_bm_lmt of the boom 6 is larger than the boom target velocity Vc_bm, the routine advances to step S9. The limit velocity Vc_bm_lmt of the boom 6 is selected as the boom command velocity in step S9.

Whether or not the distance d is smaller than the second predetermined value dth2 is determined in step S10. The second predetermined value dth2 is smaller than the above-mentioned first predetermined value dth1. If the distance d is smaller than the second predetermined value dth2, the routine advances to step S11. Whether or not the current deviation amount $d_n$ is larger than the previous deviation amount $d_{n-1}$ is determined in step S11. If the current deviation amount $d_n$ is larger than the previous deviation amount $d_{n-1}$, the routine advances to step S12.

The limit velocity Vc_am_lmt of the arm 7 is selected as the arm command velocity in step S12. If the distance d is determined to be equal to or greater than the second predetermined value dth2 in step S10, the routine advances to step S13. If the current deviation amount $d_n$ is equal to or less than the previous deviation amount $d_{n-1}$ in step S11, the routine advances to step S13. The arm target velocity Vc_am is selected as the arm command velocity in step S13.

Command signals corresponding to the boom command velocity, the arm command velocity, and the bucket command velocity are output to the control valve 27 in step S14. In this case, the boom command velocity is the limit velocity Vc_bm_lmt of the boom 6. The bucket command velocity is the bucket target velocity Vc_bkt. If at least one of the determinations performed in step S10 and step S11 is No, the arm command velocity is the arm target velocity Vc_am. Conversely, if both of the determinations performed in step S10 and step S11 are Yes, the arm command velocity is the limit velocity Vc_am_lmt of the arm 7.

Therefore, when the first limit condition is satisfied, while the boom 6 is limited to the limit velocity Vc_bm_lmt of the boom 6, the arm 7 is not limited and moves in accordance with the arm operation amount. Conversely, when the second limit condition is satisfied, the boom 6 is limited to the limit velocity Vc_bm_lmt of the boom 6, and the arm 7 is limited to the limit velocity Vc_am_lmt of the arm 7.

If the determination in step 8 is No, that is if the limit velocity Vc_bm_lmt of the boom 6 is equal to or less than the boom target velocity Vc_bm, the routine advances to step S15. The boom target velocity Vc_bm is selected as the boom command velocity in step S15. Command signals corresponding to the boom command velocity, the arm command velocity, and the bucket command velocity are output to the control valve 27 in step S16. In this case, the boom command velocity is the boom target velocity Vc_bm. The bucket command velocity is the bucket target velocity Vc_bkt. The arm command velocity is the arm target velocity Vc_am. Therefore, when both the first limit condition and the second limit condition are not satisfied, neither the boom 6 nor the arm 7 are limited and both are respectively operated in accordance with the boom operation amount and the arm operation amount.

Features of the control system 300 according to the present embodiment are described below. When the first limit condition is satisfied, the boom 6 is controlled to match the limit velocity Vc_bm_lmt and the arm 7 is controlled to match the arm target velocity Vc_am. Therefore, only the boom 6 is limited and the arm 7 is not limited when the blade tip P4 of the bucket 8 is above the design plane 41. As a result, the bucket 8 can be prevented from entering the design plane 41 while reducing the discomfort felt by the operator.

When the second limit condition is satisfied, the boom 6 is controlled to match the limit velocity Vc_bm_lmt and the arm 7 is controlled to match the arm limit velocity Vc_am_lmt. Therefore, both the boom 6 and the arm 7 are limited when the blade tip P4 of the bucket 8 enters the design plane 41. As a result, an increase of the entry into the design plane 41 can be quickly suppressed.

The second limit condition includes the condition that a current deviation amount $d_n$ is larger than a previous deviation amount $d_{n-1}$. In this case, both the limitation of the boom 6 and the limitation of the arm 7 can be performed when the entry into the design plane 41 by the bucket 8 is about to increase. In other words, only the limitation of the boom 6 is performed and the limitation of the arm 7 is not performed when the entry into the design plane 41 is not about to increase even if the blade tip P4 of the bucket 8 is below the design plane 41. As a result, a sense of discomfort for the operator can be suppressed.

The arm deceleration coefficient is determined on the basis of the current deviation amount $d_n$ and the displacement amount $\Delta d$ between the previous position and the current position of the blade tip P4 of the bucket 8. Consequently, the velocity of the arm 7 can be greatly reduced when the entry into the design plane 41 by the bucket 8 is about to increase.

Although an embodiment of the present invention has been described so far, the present invention is not limited to the above embodiments and various modifications may be made within the scope of the invention.

While a hydraulic excavator is used as an example of a construction machine in the above embodiment, the construction machine is not limited to a hydraulic excavator and other types of construction machines may be applicable to the present invention.

Obtaining the position of the blade tip P4 is not limited to GNSS and another positioning means may be used. Therefore, obtaining the distance d between the blade tip P4 and the design plane 41 is not limited to GNSS and another positioning means may be used.

The boom operation amount, the arm operation amount, and the bucket operation amount are not limited to electrical signals indicating a position of the operating member and may be obtained from a pilot pressure output in accordance with operation of the operating device 25.

The second limit condition may only be the condition that the distance d is smaller than the second predetermined value dth2. Alternatively, the second limit condition may also include other conditions. While the second limit condition includes the condition that the absolute value of the arm limit velocity Vc_am_lmt is smaller than the absolute value of the arm target velocity Vc_am in the above embodiments, the same condition may be included in the first limit condition. Alternatively, the determination of the second limit condition may not be performed and only the determination of the first limit condition may be performed. The first limit condition may also include other conditions. For example, the first limit condition may also include the condition that the operation amount is 0. Alternatively, the first limit condition may not include the condition that the distance d is smaller than the first predetermined value dth1. For example, the first limit condition may only be the condition that the limit velocity of the boom 6 is larger than the boom target velocity.

The second predetermined value dth2 may be larger than 0 as long as the second predetermined value dth2 is smaller than the first predetermined value dth1. In this case, both the limitation of the boom 6 and the limitation of the arm 7 are performed before the blade tip P4 of the bucket 8 reaches the design plane 41. As a result, both the limitation of the boom 6 and the limitation of the arm 7 can be performed when the blade tip P4 of the bucket 8 is about to cross the design plane 41 even before the blade tip P4 of the bucket 8 reaches the design plane 41.

The arm deceleration coefficient is not limited to the abovementioned method and may be determined by another method. For example, the arm deceleration coefficient may be determined in accordance with the distance d between the blade tip P4 and the design plane 41. Alternatively, the arm deceleration coefficient may be a fixed value.

Figure 17:
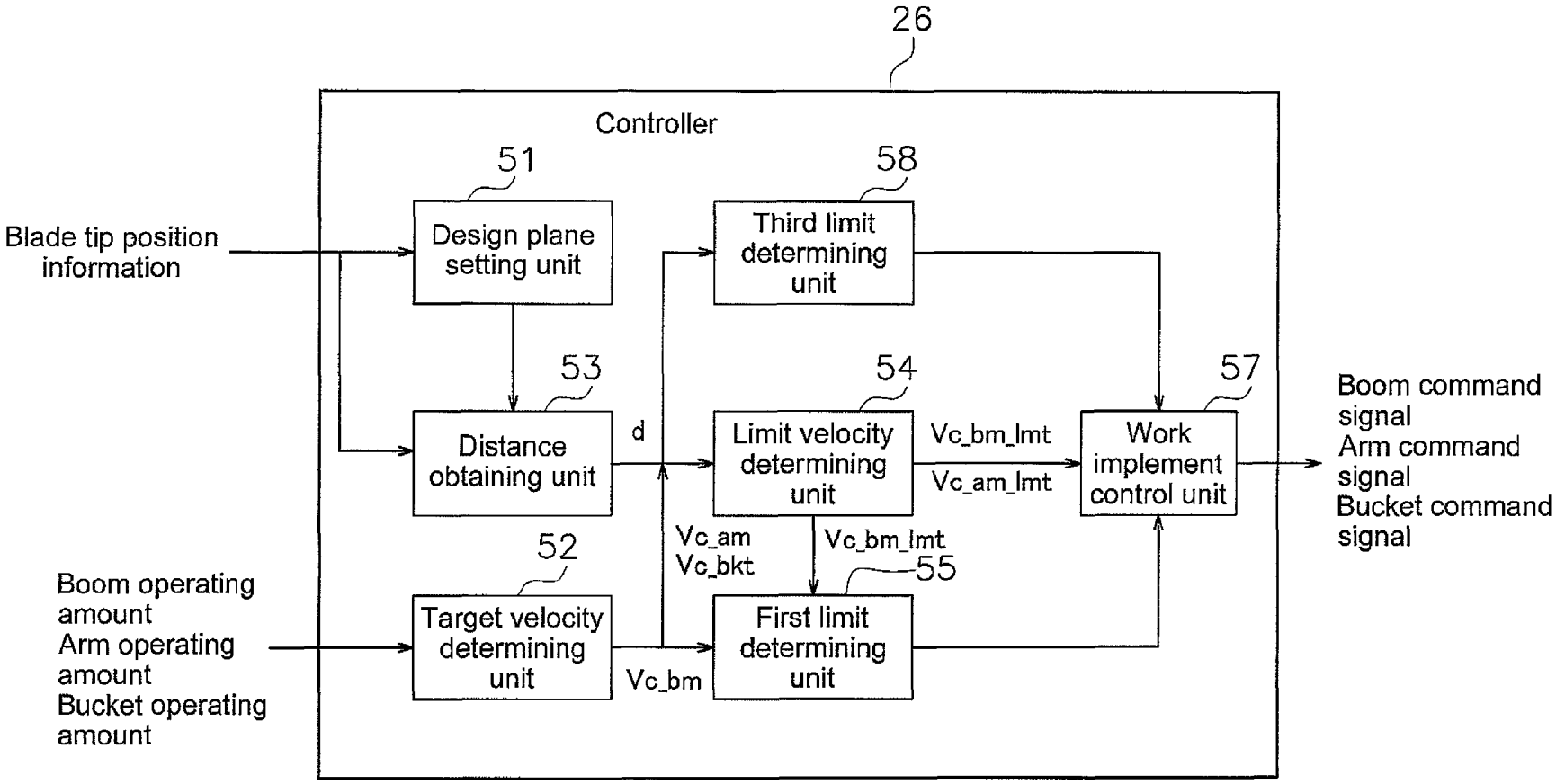
FIG. 17 is a block diagram of a configuration of a controller according to another embodiment.

A limitation of the bucket 8 may be performed instead of the abovementioned limitation of the arm 7. As illustrated in FIG. 17 in this case, the controller 26 has a third limit determining unit 58 instead of the second limit determining unit 56. The third limit determining unit 58 is a limit determining unit for limiting the bucket 8 and determines whether or not a third limit condition is satisfied. When the third limit condition is satisfied, the work implement control unit 57 controls the boom 6 to match the boom limit velocity and controls the bucket to match the bucket limit velocity. An absolute value of the bucket limit velocity is smaller than an absolute value of the bucket target velocity. The bucket limit velocity may be calculated, for example, by a means similar to the means for calculating the abovementioned arm limit velocity. The third limit condition may have the same conditions as the abovementioned second limit condition. The limitation of the arm 7 may be performed with the limitation of the bucket 8. That is, the controller 26 may have both the second limit determining unit 56 and the third limit determining unit 58.

According to the present invention, the bucket is prevented from entering the design plane while reducing the discomfort felt by the operator in the construction machine.

What is claimed is:

1. A control system for a construction machine equipped with a work implement and an operating device used to operate the work implement, the work implement having a boom, an arm, and a bucket, the control system comprising:

a design plane setting unit configured to set a design plane indicating a target shape to be excavated;

a target velocity determining unit configured to determine a boom target velocity in accordance with an operation amount of the operating device to operate the boom, an arm target velocity in accordance with an operation amount of the operating device device to operate the arm, and a bucket target velocity in accordance with an operation amount of the operating device device to operate the bucket;

a distance obtaining unit configured to obtain a distance between a blade tip of the bucket and the design plane;

a limit velocity determining unit configured to determine a limit velocity of an entirety of work implement based on the distance;

a first limit determining unit configured to determine whether a first limit condition is satisfied;

a second limit determining unit configured to determine whether a second limit condition is satisfied; and a work implement control unit configured to control the work implement, the limit velocity determining unit being configured to determine a limit velocity of the boom from the limit velocity of the entirety of the work implement, the arm target velocity, and the bucket target velocity, the distance when the blade tip of the bucket is positioned outside of the design plane being a positive value and a velocity in a direction from inside of the design plane toward outside of the design plane being a positive value, the first limit condition including a condition that the limit velocity of the boom is greater than the boom target velocity, and a condition that the distance is less than a first predetermined value, the work implement control unit being configured to control the boom to match the limit velocity of the boom and to control the arm to match the arm target velocity when the first limit condition is satisfied, the second limit condition including a condition that the distance is smaller than a second predetermined value, the second predetermined value being different from the first predetermined value, the work implement control unit being configured to control the boom to match the limit velocity of the boom and to control the arm to match an arm limit velocity when the second limit condition is satisfied, and an absolute value of the arm limit velocity is smaller than an absolute value of the arm target velocity.

2. The control system according to claim 1, wherein the second predetermined value is smaller than the first predetermined value.

3. The control system for the construction machine according to claim 2, wherein the second predetermined value is 0.

4. The control system for the construction machine according to claim 2, wherein the second predetermined value is greater than 0.

5. The control system for the construction machine according to claim 2, wherein the distance obtaining unit is configured to obtain a deviation amount of the blade tip of the bucket at predetermined time periods;

the deviation amount is an absolute value of a distance between the design plane and the blade tip of the bucket inside the design plane; and the second limit condition further includes a condition that a current deviation amount is larger than a previous deviation amount.

6. The control system for the construction machine according to claim 5, wherein the limit velocity determining unit is configured to determine an arm deceleration coefficient based on the current deviation amount and a displacement amount between a previous position and a current position of the blade tip of the bucket;

the arm deceleration coefficient is greater than 0 and smaller than 1; and the limit velocity determining unit is configured to determine the arm limit velocity by multiplying the arm target velocity by the arm deceleration coefficient.

7. The control system for the construction machine according to claim 1, wherein the work implement control unit is configured to reduce a velocity of the boom to a velocity lower than the boom target velocity when the first limit condition or the second limit condition is satisfied and the limit velocity of the entirety of the work implement is smaller than a sum of the arm target velocity and the bucket target velocity.

8. The control system for the construction machine according to claim 1, wherein the work implement control unit is configured to move the boom in the direction from inside the design plane to outside the design plane when the first limit condition or the second limit condition is satisfied and the limit velocity of the entirety of the work implement is larger than a sum of the arm target velocity and the bucket target velocity.

9. The control system according to claim 1, further comprising:

a third limit determining unit configured to determine whether a third limit condition is satisfied, the third limit condition including a condition that the distance is smaller than the second predetermined value, the work implement control unit is configured to control the boom to match the limit velocity of the boom and to control the bucket to match a bucket limit velocity when the third limit condition is satisfied, and an absolute value of the bucket limit velocity being smaller than an absolute value of the bucket target velocity.

10. A construction machine including the control system according to claim 1.

11. A control method for controlling a construction machine equipped with a work implement and an operating device used to operate the work implement, the work implement including a boom, an arm and a bucket, the control method comprising:

setting a design plane indicating a target shape to be excavated;

determining a boom target velocity in accordance with an operation amount of the operating device to operate the boom, an arm target velocity in accordance with an operation amount of the operating device to operate the arm, and a bucket target velocity in accordance with an operation amount of the operating device to operate the bucket;

obtaining a distance between a blade tip of the bucket and the design plane;

determining a limit velocity of an entirety of the work implement based on the distance;

determining a limit velocity of the boom from the limit velocity of the entirety of the work implement, the arm target velocity, and the bucket target velocity, determining whether a first limit condition is satisfied, the first limit condition including a condition that the limit velocity of the boom is greater than the boom target velocity, and a condition that the distance is less than a first predetermined value, and determining whether a second limit condition is satisfied, the second limit condition including a condition that the distance is smaller than a second predetermined value, the second predetermined value being different from the first predetermined value; and controlling the work implement, the distance when the blade tip of the bucket is positioned outside of the design plane being a positive value and a velocity in a direction from inside of the design plane toward outside of the design plane being a positive value, and the controlling the work implement including controlling the boom to match the limit velocity of the boom and controlling the arm to match the arm target velocity when the first limit condition is satisfied, and controlling the work implement including controlling the boom to match the limit velocity of the boom and to control the arm to match an arm limit velocity when the second limit condition is satisfied, and an absolute value of the arm limit velocity being smaller than an absolute value of the arm target velocity.

* * * * *